US008105038B2

(12) United States Patent
Ootomo et al.

(10) Patent No.: US 8,105,038 B2
(45) Date of Patent: Jan. 31, 2012

(54) STEAM TURBINE, AND INTERMEDIATE SUPPORT STRUCTURE FOR HOLDING ROW OF LONG MOVING BLADES THEREIN

(75) Inventors: Fumio Ootomo, Kanagawa (JP); Hisashi Matsuda, Tokyo (JP); Asako Inomata, Tokyo (JP); Hiroyuki Kawagishi, Kanagawa (JP); Yoshiki Niizeki, Tokyo (JP); Naoki Shibukawa, Saitama (JP); Hiroshi Kawakami, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 838 days.

(21) Appl. No.: 12/145,299

(22) Filed: Jun. 24, 2008

(65) Prior Publication Data

US 2009/0004011 A1 Jan. 1, 2009

(30) Foreign Application Priority Data

Jun. 27, 2007 (JP) ..... 2007-168942

(51) Int. Cl.
*F03B 3/12* (2006.01)
*F01D 5/22* (2006.01)

(52) U.S. Cl. ..... 416/194; 416/196 R

(58) Field of Classification Search ..... 416/194, 416/195, 196 R
See application file for complete search history.

(56) References Cited

U.S. PATENT DOCUMENTS

| | | | | | |
|---|---|---|---|---|---|
| 791,837 | A | * | 6/1905 | Sweet | 416/196 R |
| 937,006 | A | * | 10/1909 | Mckee | 416/196 R |
| 1,698,327 | A | * | 1/1929 | Doran | 416/196 R |
| 2,082,914 | A | * | 6/1937 | Soderberg | 416/196 R |
| 2,198,784 | A | * | 4/1940 | Mikina | 416/196 R |
| 2,245,237 | A | * | 6/1941 | Truex | 415/209.4 |
| 2,278,040 | A | * | 3/1942 | Allen | 416/191 |
| 2,454,115 | A | * | 11/1948 | Allen | 416/196 R |
| 2,472,886 | A | * | 6/1949 | Conrad et al. | 416/193 R |
| 2,772,854 | A | * | 12/1956 | Anxionnaz | 416/190 |
| 3,327,995 | A | * | 6/1967 | Blackhurst et al. | 416/196 R |
| 3,612,718 | A | * | 10/1971 | Palfreyman et al. | 416/135 |
| 3,795,462 | A | * | 3/1974 | Trumpler, Jr. | 416/196 R |
| 4,083,655 | A | * | 4/1978 | Tempere | 416/196 R |
| 4,257,743 | A | * | 3/1981 | Fujii | 416/196 R |
| 4,722,668 | A | * | 2/1988 | Novacek | 416/190 |
| 4,734,010 | A | * | 3/1988 | Battig | 416/196 R |
| RE32,737 | E | * | 8/1988 | Ortolano | 416/190 |
| 5,275,531 | A | * | 1/1994 | Roberts | 415/173.1 |
| 5,393,200 | A | * | 2/1995 | Dinh et al. | 416/223 A |
| 5,460,488 | A | * | 10/1995 | Spear et al. | 416/193 R |
| 5,498,136 | A | * | 3/1996 | Namura et al. | 416/190 |
| 5,695,323 | A | * | 12/1997 | Pfeifer et al. | 416/190 |

FOREIGN PATENT DOCUMENTS

| | | | |
|---|---|---|---|
| CN | 2851582 | Y | 12/2006 |
| GB | 2 264 446 | A | 9/1993 |
| JP | 6-010613 | A | 1/1994 |
| JP | 6-248902 | A | 9/1994 |

* cited by examiner

*Primary Examiner* — Scott B Geyer
(74) *Attorney, Agent, or Firm* — Foley & Lardner LLP

(57) ABSTRACT

A row of moving blades for a steam turbine has moving blades elongated radially which are arranged peripherally around and secured to a turbine rotor. The row also has an intermediate support structure for holding the blades to each other at a radially intermediate position. The support structure has a shape of a streamline cross section. The support structure may include a tie wire secured to the blades, or lugs protruding from the blades and combined to each other. The support structure may include lugs protruding from the blades to each other, and a sleeve combining the lugs. The shape of a streamline cross section may have an obtuse-angle or acute-angle upstream part.

16 Claims, 5 Drawing Sheets

STEAM TURBINE, AND INTERMEDIATE SUPPORT STRUCTURE FOR HOLDING ROW OF LONG MOVING BLADES THEREIN

CROSS REFERENCES TO RELATED APPLICATIONS

This application is based upon and claims the benefits of priority from the prior Japanese Patent Application No. 2007-168942, filed on Jun. 27, 2007; the entire content of which is incorporated herein by reference.

BACKGROUND OF THE INVENTION

The present invention relates to an intermediate support structure for holding a row of long moving blades in a steam turbine. More particularly, the invention relates to an intermediate support structure for holding rows of long moving blades in low-pressure stage of a steam turbine, and relates to a steam turbine.

In a typical steam turbine, the moving blade rows are arranged peripherally and planted on the outer circumferential surface of the turbine rotor. The stationary blade rows are secured to the turbine casing. The moving blade rows and the stationary blade rows are alternately arranged in the axial direction of the turbine rotor. One moving blade row and one stationary blade row (called "nozzles") make a blade row pair, which is known as "a stage." The stages are axially arranged, constituting the turbine. As fluid flows through the gap between the blades of every stage, the turbine rotor rotates.

Thus, the moving blades of the steam turbine convert the energy of steam to a mechanical rotational force, which is transmitted to the turbine rotor. Steam at high temperature and high pressure gradually expands, flowing through the stages, each composed of moving blades and nozzles, and exerting a rotational force to each moving blade.

The moving blades are planted on the turbine rotor, and the turbine rotor rotates at high speed. A large centrifugal force and rotational vibration are inevitably applied, particularly, to the long moving blades that are used in the low-pressure stages of the steam turbine. In addition, the rows of long moving blades are important components because they significantly affect the efficiency of the entire turbine, the output power of the turbine and the size of the plant including the turbine. Hence, it is important to make sure that the rows of long moving blades have an appropriate strength in the process of designing the steam turbine.

To reinforce the rows of long moving blades, making them strong enough to withstand the above-mentioned large centrifugal force and rotational vibration, intermediate support members, such as tie wires or lugs, have hitherto been used, coupling the moving blades to one another in peripheral direction. The moving blade rows are thereby reinforced (see Japanese Patent Application Laid-Open Publication Nos. 06-248902 and 06-010613, the entire contents of which are incorporated herein by reference.).

As shown in FIGS. 1 and 2, the conventional intermediate support members that reinforce the strength of the moving blade rows are lugs 3 (FIG. 2), or lugs and sleeves, or tie wires (not shown). The intermediate support members have a circular or elliptical cross section. So shaped, the intermediate support members greatly block the main steam flow that passes through the gap between any two adjacent moving blades 1. Consequently, the main-steam flow separation is induced as shown in FIGS. 3 and 4, inevitably causing the fluid loss.

BRIEF SUMMARY OF THE INVENTION

The present invention has been made to solve the problems specified above. An object of the invention is to provide a steam turbine in which intermediate support members couple the moving blades to one another, preventing the main steam flow from separating, thereby reducing the fluid loss, while keeping the rows of moving blades having a large strength.

According to an aspect of the present invention, there is provided a row of moving blades for a steam turbine, the row comprising: a plurality of moving blades elongated radially, and arranged peripherally around and secured to a turbine rotor; and an intermediate support structure for holding the blades each other at a radially intermediate position, the intermediate support structure having a shape of streamline cross section.

According to another aspect of the present invention, there is provided a steam turbine comprising at least one row of moving blades described above.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Embodiments of an intermediate support structure for holding a row of long moving blades in a steam turbine according to the present invention will be described with reference to the accompanying drawings.

First Embodiment

Figure 5:
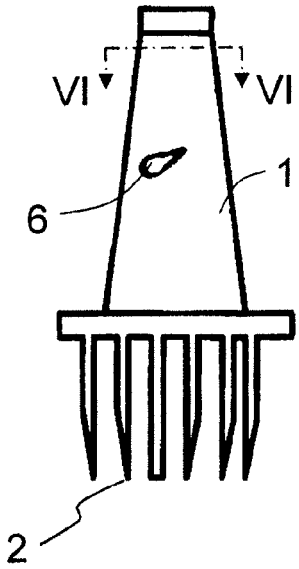
FIG. 5 is a diagram showing one of the long moving blades according to a first embodiment of the present invention.
Figure 6:
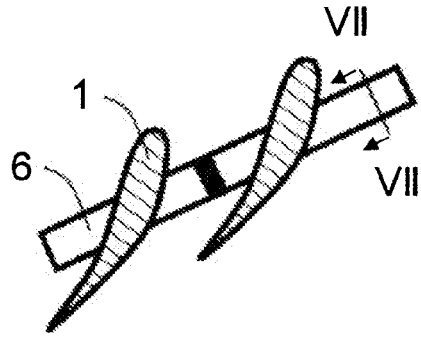
FIG. 6 is a sectional view taken along line VI-VI in FIG. 5 showing moving blades with the lugs of the first embodiment.

A first embodiment of the present invention will be described with reference to FIGS. 5 to 7. The components identical or similar to those of the above-described background art are designated by the same reference numbers here.

Figure 12:
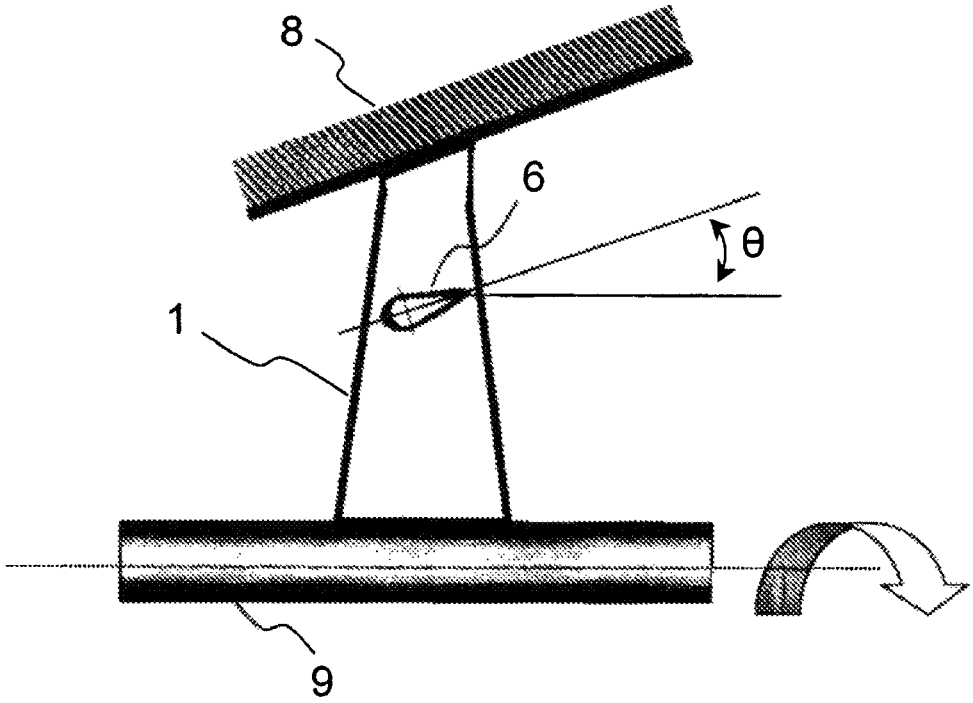
FIG. 12 is a conceptual diagram, showing a manner of securing each lug in the first embodiment.

In the first embodiment, the long moving blades 1 used in the low-pressure stage of the steam turbine have a planted part 2 each. The planted part 2 is embedded in the turbine rotor 9 (FIG. 12). Thus, the long moving blades 1 are attached to the turbine rotor 9. Each of the long moving blades 1 is elongated radially. The long moving blades are arranged peripherally around and secured to the turbine rotor 9.

A lug 6 having a streamline cross section is formed on the radially middle part of each moving blade 1. The lug 6 protrudes from the surface of the moving blade 1. The lugs 6 of the mutually adjacent moving blades protrude toward each other and are coupled to each other by welding, for example. The lugs 6 are intermediate support members that reinforce the moving blades 1, making the blades 1 strong enough to withstand a centrifugal force and vibration the blades 1 may receive while the turbine rotor 9 is rotating. Thus, a plurality of the moving blades are coupled together, forming one or more groups of the moving blades arranged in a row.

The flow-guiding characteristic of the lug 6 having a streamline cross section will be explained, in comparison with that of the conventional lug.

Figure 1:
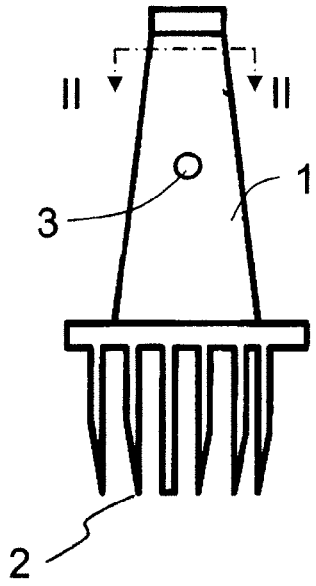
FIG. 1 PRIOR ART
FIG. 1 is a diagram showing a conventional long moving blade with a conventional lug.
Figure 2:
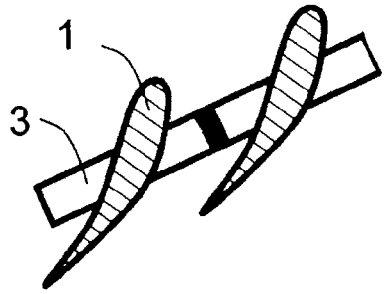
FIG. 2 PRIOR ART
FIG. 2 is a sectional view taken along line II-II in FIG. 1 showing moving blades with conventional lugs.
Figure 3:
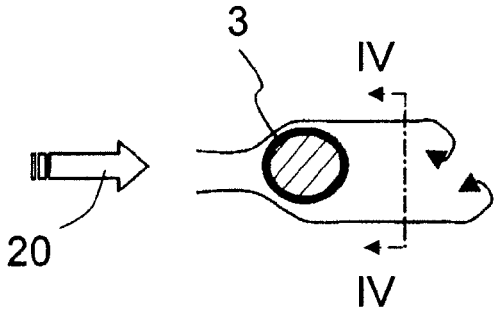
FIG. 3 PRIOR ART
FIG. 3 is a schematic diagram illustrating how steam flows as it passes by a conventional lug.
Figure 4:
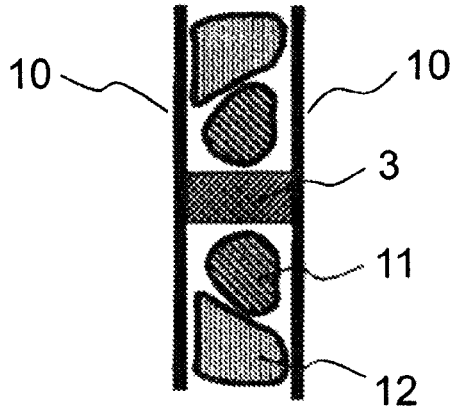
FIG. 4 PRIOR ART
FIG. 4 is a sectional view taken along line IV-IV in FIG. 3, depicting how the steam flows as it passes by the conventional lug.

FIG. 3 is a schematic diagram illustrating how steam flows as it passes by the conventional lug 3 that has a substantially circular cross section. FIG. 4 is a schematic diagram showing how steam flows after passing the lug 3 between the downstream ends 10 of the moving blades 1. Since the lug 3, i.e., intermediate support member, has a substantially circular cross section, the main stream flow separation is induced. As a result, a pair of separation vortex regions 11, in which the aerodynamic loss is large, develop at the rear of the lug 3, and the low-loss regions 12 are rather small.

Figure 8:
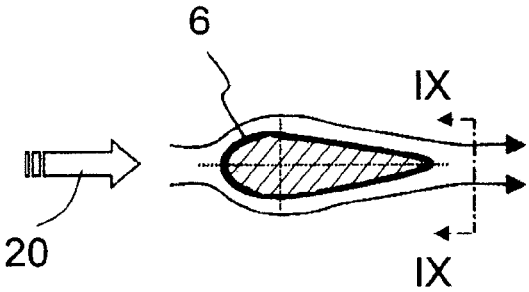
FIG. 8 is a schematic diagram illustrating how steam flows as it passes by a lug according to the first embodiment of the present invention.
Figure 9:
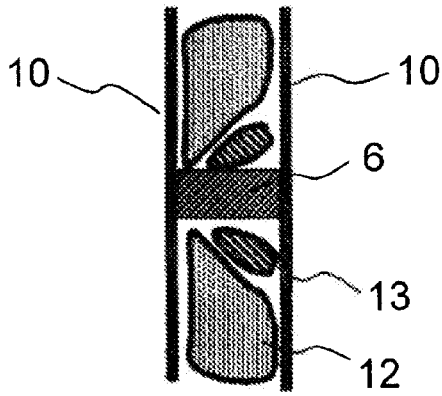
FIG. 9 is a sectional view taken along line IX-IX in FIG. 8, depicting how the steam flows as it passes by the lug according to the first embodiment of the present invention.

FIG. 8 is a schematic diagram illustrating how steam flows as it passes by the lug 6 according to the first embodiment of the present invention, which has a streamline cross section. FIG. 9 is a schematic diagram showing how steam flows after passing this lug 6. Since the lug 6, i.e., intermediate support member, has a streamline cross section, the main stream flow 20 does not induce separation flow at the outer circumferential surface of the lug 6. As a result, a pair of wakes 13, in which the aerodynamic loss is small, are generated at the rear of the lug 6. Hence, a broad low-loss regions 12 develop between the two blades coupled by the lug 6.

Figure 10:
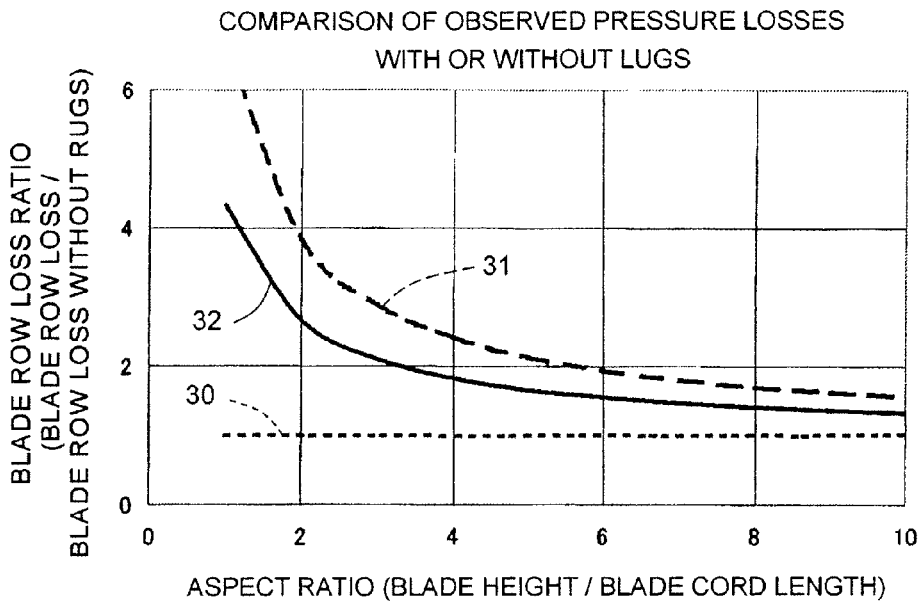
FIG. 10 is a graph showing the pressure losses that were observed when no lug was used, when the conventional lugs were used and when the lugs according the first embodiment were used.

FIG. 10 is a graph showing the aerodynamic losses that were observed when no lug was used (the dotted line 30), when the conventional lug 3 was used (the dashed line 31), and when the lug 6 according this invention was used (the solid line 32). In FIG. 10, the aspect ratio, i.e., the ratio of the blade height to the blade-cord length, is plotted on the axis of abscissa as a dimensionless quantity. Moreover, the blade-row loss ratio, i.e., the ratio of the loss at a blade row using lugs to the loss at a blade row using no lugs, is plotted on the axis of ordinate as a dimensionless quantity. The loss at any blade row using no lugs is always unity (1.0), irrespective of the aspect ratio. In a region where the aspect ratio is small, the blade-row loss is large because the aerodynamic loss is large and is predominant in the space. The total blade-row loss in the space indeed tends to decrease gradually as the aspect ratio increases. However, the aerodynamic loss due to the lugs remains large. The long moving blades for use in turbines may preferably have an aspect ratio of 4 or more. They may be therefore reinforced with intermediate support members. The lugs 6 having a streamline cross section, according to the first embodiment of the present invention, can greatly reduce the aerodynamic loss if they are used in place of the conventional lugs 3.

Figure 7:
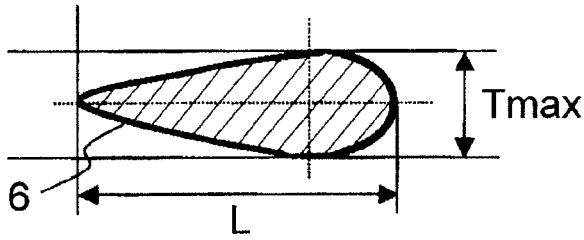
FIG. 7 is a sectional view of a lug, taken along line VII-VII in FIG. 6.
Figure 11:
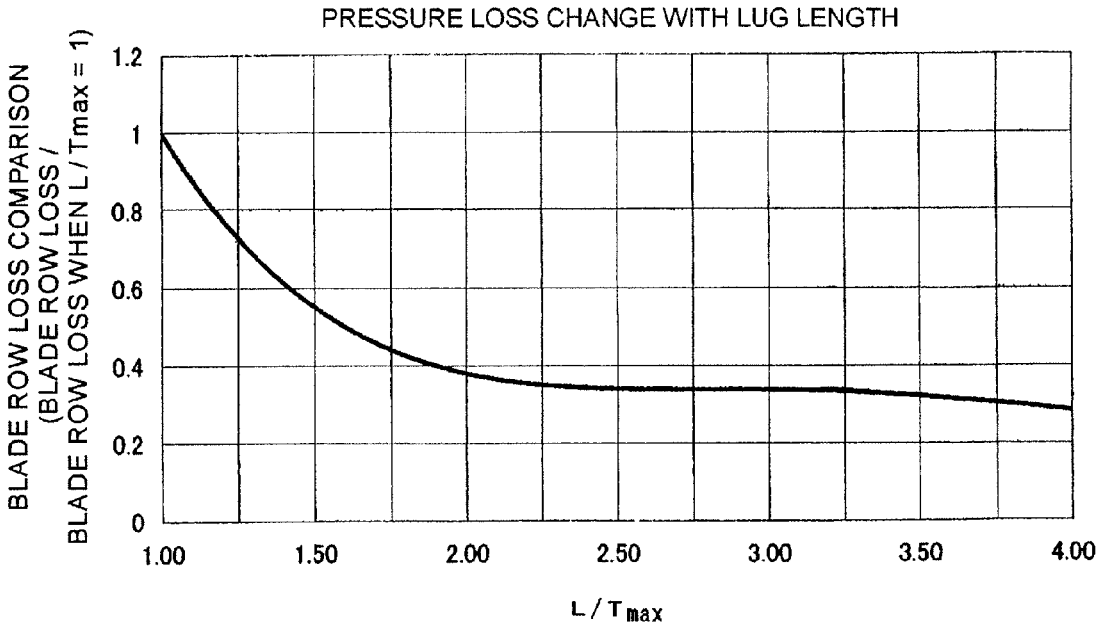
FIG. 11 is a graph showing how the pressure loss changes with the length of the lugs.

FIG. 11 is a graph showing how the blade-row loss changes with L/Tmax, where L is the overall length of the lug 6 having a streamline cross section and Tmax is the maximum thickness of the lug 6 as shown in FIG. 7. L/Tmax may well be 1.23 or more since the tolerance value for fluid loss is 80% or less. The upper limit of L/Tmax should preferably be 3.5 in view of the strength required of the lugs.

With reference to FIG. 12, the angle θ at which the lugs 6 should be secured will be explained. This angle θ can be of any value so long as the direction (i.e., wing-cord direction) in which the lugs 6 extend inclines to the direction of the axis of the turbine rotor 9 at an angle that falls within the range for the inclination angle of the casing 8. As FIG. 12 shows, each streamline-shaped lug 6 may be inclined, parallel to the actual main steam flow that inclines to the direction of height of the blade 1. This would not only prevent the main steam flow separation that might be separating away from the surfaces of the lug 6, but also would decrease the width of the resulting wake. As a result, the speed-loss region in the wake can be narrowed, reducing the aerodynamic loss at the blade row even more.

In the first embodiment so configured as described above, the main steam flow that passes the lug 6 each does not separate because the lug 6 coupling two adjacent blades 1 has a streamline cross section. No large vortexes therefore develop in the wake at the rear of the streamline-shaped lug 6. Thus, the speed-loss region in the wake is small, decreasing the fluid loss. The present embodiment can therefore provide a steam turbine having strong moving blade rows, in which the moving blades do not vibrate.

Figure 13:
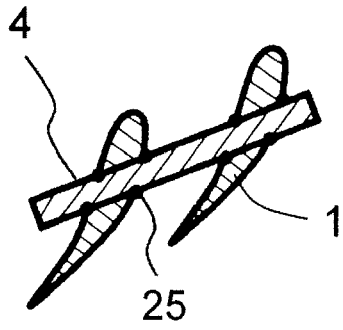
FIG. 13 is a diagram showing one of the tie wires used in an alternative example of the first embodiment of the present invention.

In the embodiment described above, the streamline-shaped lugs 6 are used as intermediate support members. The streamline-shaped lugs 6 may be replaced by a streamline-shaped tie wire 4 which is shown in FIG. 13. The tie wire 4 penetrates the moving blades 1 and is welded to the moving blades 1 at welding points 25. In this case, too, such advantages as described above can be of course achieved.

Second Embodiment

Figure 14:
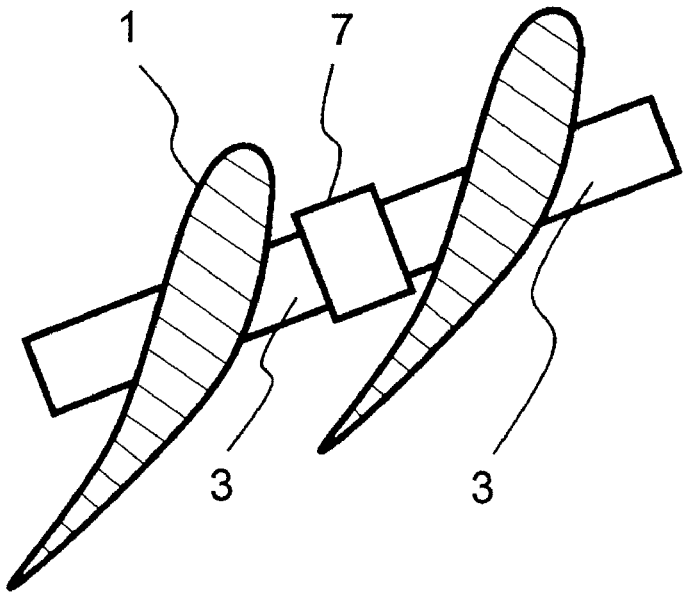
FIG. 14 is a diagram showing one of the "lug sleeve" configuration used in a second embodiment of the present invention.

A second embodiment of the present invention will be described with reference to FIG. 14. The components identical or similar to those of the first embodiment are designated by the same reference numbers and will not be described here.

In the second embodiment, the streamline-shaped lugs 6 are not directly coupled to one another as in the first embodiment. Instead, lugs 3 of two adjacent moving blades 1 are coupled to each other via an intermediate member such as a streamline-shaped sleeve 7. Two lugs 3 protruding from the two associated blades 1, respectively, and one streamline-shaped sleeve 7 constitute a "lug-sleeve" unit. Since the sleeve 7 of each lug-sleeve unit has a streamline cross section, the fluid loss can be greatly reduced in the second embodiment. The fluid loss can be reduced still more if the lugs 3 have a streamline cross section as the lugs 6 used in the first embodiment.

The second embodiment thus configured can achieve the same advantages as the first embodiment. Further, the intermediate support members can be attached more easily than in the first embodiment, because they are lug-sleeve units. Moreover, the components that greatly influence the fluid loss are shaped in streamlines, which helps to lower the manufacturing cost of the turbine, while successfully decreasing the aerodynamic loss.

Third Embodiment

A third embodiment of the present invention will be described with reference to FIGS. 15 and 16. The components identical or similar to those of the first and second embodiments are designated by the same reference numbers and will not be described here.

In the third embodiment, the streamline cross section of each intermediate support member is changed in shape in accordance with the incidence angle of the main stream flow 20.

The angle at which the main steam flow comes to each moving blade of the steam turbine largely depends on the change in the plant output power. In a steam turbine driven always at its rated condition (i.e., at 100% load), the incidence angle of the upstream main stream flow 20 is relatively constant, changing only a little. In any steam turbine installed in a plant in which the load is frequently adjusted, however, the incidence angle of the upstream main stream flow 20 greatly changes.

Figure 15:
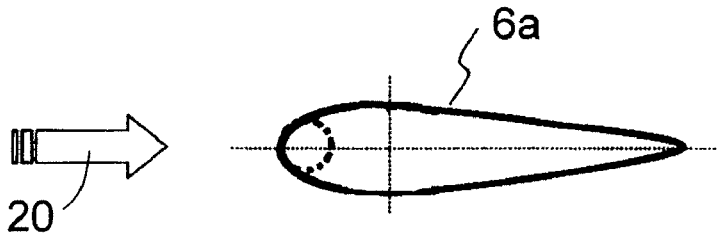
FIG. 15 is a sectional view of an acute-angle, streamline lug according to a third embodiment of the present invention.
Figure 16:
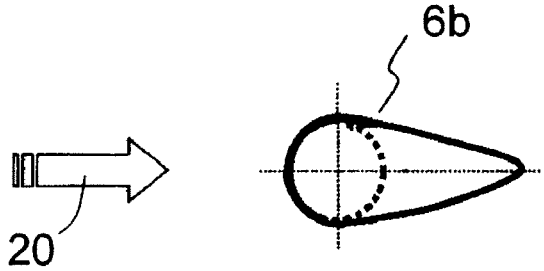
FIG. 16 is a sectional view of an obtuse-angle, streamline lug according to another example of the third embodiment of the present invention.

In a steam turbine installed in a plant the output power of which does not change much, acute-angle, streamline-shaped lugs 6*a* of the type shown in FIG. 15 may be used as intermediate support members. Then, the main steam flow is less likely to separate, whereby the fluid loss can be decreased.

By contrast, in a steam turbine installed in a plant the output power of which changes much, the angle of incidence of the main steam flow may be larger than the angle at which the intermediate support members are attached. In this case, the intermediate support members will increase the fluid loss if they are acute-angle, streamline-shaped lugs. Therefore, in a steam turbine installed in a plant the load of which is frequently adjusted, obtuse-angle streamline-shaped lugs 6*b* of the type shown in FIG. 16 may be preferably used. Then, the main steam flow is less likely to separate, whereby the fluid loss can be decreased.

The term "obtuse-angle, streamline-shaped lug" means a lug whose head part (or most upstream part), which receives the main steam flow, has a substantially circular cross section, and whose tail part is streamline-shaped and smoothly continuous to the head part. The head part of the lug may have an elliptical cross section, not a circular cross section. If its cross section is circular, the cross section has a diameter equal to the maximum thickness Tmax of the lug. If its cross section is elliptical, the minor or major axis is the maximum thickness Tmax.

In the third embodiment thus configured, if the main stream flow 20 is stable in direction, intermediate support members having an acute-angle, streamline cross section are used, preventing the main steam flow from flow separation and ultimately maintaining the fluid loss at a small value. If the main stream flow 20 greatly changes in direction, intermediate support members having an obtuse-angle streamline cross section are used, reducing flow separation regions in size and ultimately maintaining the fluid loss at a small value.

Other Embodiments

The embodiments explained above are merely examples, and the present invention is not restricted thereto. It is, therefore, to be understood that, within the scope of the appended claims, the present invention can be practiced in a manner other than as specifically described herein.

What is claimed is:

1. A row of moving blades for a steam turbine, the row comprising:

a plurality of moving blades elongated radially, and arranged peripherally around and secured to a turbine rotor; and an intermediate support structure for holding the blades to each other at a radially intermediate position, the intermediate support structure having a shape of a streamline cross section with an obtuse-angle upstream part, wherein a thickest part of the intermediate support structure is located upstream of a center of the intermediate support structure in a flow direction thereof.

2. The row of moving blades according to claim 1, wherein the intermediate support structure includes a tie wire secured to the blades.

3. The row of moving blades according to claim 1, wherein the intermediate support structure includes lugs protruding from the blades to each other and coupled to each other.

4. The row of moving blades according to claim 1, wherein the intermediate support structure includes: lugs protruding from the blades to each other, and a sleeve coupling the lugs to each other.

5. The row of moving blades according to claim 4, wherein the lugs have a shape of a streamline cross section.

6. The row of moving blades according to claim 4, wherein the sleeve has a shape of a streamline cross section.

7. The row of moving blades according to claim 1, wherein a formula of $L/Tmax \geqq 1.23$ is satisfied, where L is an axial length of the intermediate support structure and Tmax is a maximum thickness thereof.

8. A steam turbine comprising at least one row of moving blades of claim 1.

9. A row of moving blades for a steam turbine, the row comprising:

a plurality of moving blades elongated radially, and arranged peripherally around and secured to a turbine rotor; and an intermediate support structure for holding the blades to each other at a radially intermediate position, the intermediate support structure having a shape of a streamline cross section with an acute-angle upstream part, wherein a thickest part of the intermediate support structure is located upstream of a center of the intermediate support structure in a flow direction thereof.

10. The row of moving blades according to claim 9, wherein the intermediate support structure includes a tie wire secured to the blades.

11. The row of moving blades according to claim 9, wherein the intermediate support structure includes lugs protruding from the blades to each other and coupled to each other.

12. The row of moving blades according to claim 9, wherein the intermediate support structure includes: lugs protruding from the blades to each other, and a sleeve coupling the lugs to each other.

13. The row of moving blades according to claim 12, wherein the lugs have a shape of a streamline cross section.

14. The row of moving blades according to claim 12, wherein the sleeve has a shape of a streamline cross section.

15. The row of moving blades according to claim 9, wherein a formula of $L/Tmax \leqq 1.23$ is satisfied, where L is an axial length of the intermediate support structure and Tmax is a maximum thickness thereof.

16. A steam turbine comprising at least one row of moving blades of claim 9.

* * * * *